US010189661B1

(12) United States Patent
Segal et al.

(10) Patent No.: US 10,189,661 B1
(45) Date of Patent: Jan. 29, 2019

(54) VACUUM WHEEL WITH SEPARATE CONTACT AND VACUUM SURFACES

(71) Applicant: Core Flow Ltd., Daliyat el-Karmel (IL)

(72) Inventors: Alon Segal, Kiriyat Tivon (IL); Yaacov Legerbaum, Haifa (IL)

(73) Assignee: Core Flow Ltd., Daliyat El-Karmel ( * ) Notice: Subject to any disclaimer, the term of this patent is extended or adjusted under 35 U.S.C. 154(b) by 0 days.

(21) Appl. No.: 15/678,107

(22) Filed: Aug. 15, 2017

(51) Int. Cl.
*B65H 5/22* (2006.01)

(52) U.S. Cl.
CPC ..... *B65H 5/226* (2013.01); *B65H 2211/00* (2013.01); *B65H 2701/19* (2013.01)

(58) Field of Classification Search
CPC ..... B65H 5/226; B65H 2406/3122; B65H 2406/33; B65H 2406/331; B65H 2406/361; B65H 2406/3614; B65H 2406/3223; B65H 2406/332
See application file for complete search history.

(56) References Cited

U.S. PATENT DOCUMENTS 4,168,829 A * 9/1979 Wilson ..... B65H 3/10 271/108
5,829,740 A * 11/1998 Kerpe ..... B65H 29/686 271/276
8,119,055 B2 * 2/2012 Pellengo Gatti ..... B65H 18/00 242/417
2008/0302637 A1 12/2008 Yassour
2009/0051747 A1 * 2/2009 Okada ..... B41J 13/226 347/104

FOREIGN PATENT DOCUMENTS

JP 2009234707 10/2009
JP 2010116248 12/2011

OTHER PUBLICATIONS

International Search Report for PCT Application No. PCT/IL2018/050755 dated Oct. 9, 2018.

* cited by examiner

*Primary Examiner* — Michael C McCullough
(74) *Attorney, Agent, or Firm* — Pearl Cohen Zedek Latzer Baratz LLP

(57) ABSTRACT

A vacuum wheel for transporting a substrate includes a fixed conduit that is connectable to a suction source. A vacuum surface on a circumference of the vacuum wheel includes vacuum openings that are distributed around the circumference, such that rotation of the wheel causes the vacuum openings to successively fluidically connect to the fixed conduit. When suction is applied to the fixed conduit, suction is applied to one or more of the vacuum openings that are currently fluidically connected to the fixed conduit. At least one contact surface on the circumference of the vacuum wheel is adjacent to, and extends outward beyond, the vacuum surface. When suction is applied to the vacuum openings, the substrate is drawn toward the vacuum surface so as to contact the contact surface without contacting the vacuum surface, creating a friction force that enables transport of the substrate when the wheel rotates.

20 Claims, 6 Drawing Sheets

VACUUM WHEEL WITH SEPARATE CONTACT AND VACUUM SURFACES

FIELD OF THE INVENTION

The present invention relates to vacuum wheels. More particularly, the present invention relates to a vacuum wheel with separate contact and vacuum surfaces.

BACKGROUND OF THE INVENTION

Various manufacturing and testing processes require conveying thin substrates from one region of a facility to another. For example, a thin substrate may include a thin sheet of glass to be incorporated in a flat screen display.

Since the substrates may be brittle, substrates may be processed and transported while being supported by a noncontact support platform. For example, a noncontact support table may cause air or another fluid to flow in such a manner so as to create a cushion of the air or other fluid on which the substrate is supported. Thus, the substrate may be supported at a sufficient distance from the noncontact support table so as to prevent contact with any physical structure of the table.

The thin substrate may be warped or distorted. The thin substrate may also be somewhat flexible so as to bend when unevenly supported or when subjected to non-uniform forces.

In order to transport the thin substrate along the noncontact support platform, a mechanism is provided to laterally propel the substrate. For example, the propulsion mechanism may include a wheel that is configured to tangentially contact the substrate. Friction between the wheel and the substrate may be sufficient such that rotation of the wheel may propel the substrate in the direction of movement of the point of tangency. Suction may be applied to hold the substrate to the wheel so as to ensure sufficient friction between the substrate and the wheel.

SUMMARY OF THE INVENTION

There is thus provided, in accordance with an embodiment of the present invention, a vacuum wheel for transporting a substrate, the vacuum wheel including: a fixed conduit that is connectable to a suction source; at least one vacuum surface on a circumference of the vacuum wheel, the vacuum surface including a plurality of vacuum openings that are distributed around the circumference, such that rotation of the wheel causes vacuum openings of the plurality of vacuum openings to successively fluidically connect to the fixed conduit such that, when suction is applied by the suction source to the fixed conduit, suction is applied to one or more of the plurality of vacuum openings that are currently fluidically connected to the fixed conduit; and at least one contact surface on the circumference of the vacuum wheel, the at least one contact surface being adjacent to and extending outward beyond the vacuum surface such that, when the suction is applied to the one or more of the plurality of vacuum openings, the substrate is drawn toward the vacuum surface, so as to contact the at least one contact surface without contacting the vacuum surface, and so as to apply a friction force between the at least one contact surface and the substrate to transport the substrate when the wheel rotates.

Furthermore, in accordance with an embodiment of the present invention, the plurality of vacuum openings are arranged in a single row.

Furthermore, in accordance with an embodiment of the present invention, a distance between a pair of adjacent vacuum openings of the plurality of vacuum openings is substantially constant.

Furthermore, in accordance with an embodiment of the present invention, each of the vacuum openings is connected via a vacuum conduit to an inner surface of a rim of the vacuum wheel.

Furthermore, in accordance with an embodiment of the present invention, an azimuthal extent of the fixed conduit is longer than a width of the fixed conduit in an axial direction.

Furthermore, in accordance with an embodiment of the present invention, the azimuthal extent of the fixed conduit is sufficient such that at least one of the vacuum openings is always fluidically connected to the fixed conduit as the vacuum wheel rotates.

Furthermore, in accordance with an embodiment of the present invention, the at least one contact surface includes two contact surfaces, wherein the two contact surfaces are located on opposite sides of the vacuum surface.

Furthermore, in accordance with an embodiment of the present invention, the two contact surfaces are equidistant from the vacuum openings of the vacuum surface.

Furthermore, in accordance with an embodiment of the present invention, a contact surface of the plurality of contact surfaces is replaceable.

Furthermore, in accordance with an embodiment of the present invention, the replaceable contact surface includes an O-ring.

Furthermore, in accordance with an embodiment of the present invention, a rim of the vacuum wheel includes holding structure for holding the replaceable contact surface in place.

Furthermore, in accordance with an embodiment of the present invention, the holding structure includes a groove.

Furthermore, in accordance with an embodiment of the present invention, the vacuum wheel includes a motor for rotating the vacuum wheel.

There is further provided, in accordance with an embodiment of the present invention, a noncontact support table for supporting and transporting a substrate, the table including: a plurality of pressure ports that are distributed across a surface of the table; a plurality of vacuum wheels, each of the vacuum wheels being mounted to the table such that an end of each of the vacuum wheels extends beyond the table surface, each vacuum wheel including: a fixed conduit that is connectable to a suction source; at least one vacuum surface on a circumference of the vacuum wheel, the vacuum surface including a plurality of vacuum openings that are distributed around the circumference, such that rotation of the wheel causes the vacuum openings of the plurality of vacuum openings to successively fluidically connect to the fixed conduit such that, when suction is applied by the suction source to the fixed conduit, the suction is applied to one or more of the plurality of vacuum openings that are currently fluidly connected to the fixed conduit; and at least one contact surface on the circumference of the vacuum wheel, the at least one contact surface being adjacent to and extending outward beyond the vacuum surface such that when the suction is applied to the one or more of the plurality of vacuum openings, the substrate is drawn toward the vacuum surface, so as to contact the at least one contact surface without contacting the vacuum surface, and so as to apply a friction force between the at least one contact surface and the substrate to transport the substrate when the wheel rotates.

Furthermore, in accordance with an embodiment of the present invention, the table includes a plurality of wheel openings, and the end of each of the vacuum wheels extends beyond the table surface through a wheel opening of the plurality of wheel openings.

Furthermore, in accordance with an embodiment of the present invention, vacuum wheels of the plurality of vacuum wheels are arranged adjacent to the table surface.

Furthermore, in accordance with an embodiment of the present invention, the noncontact support table includes a plurality of idler wheels.

Furthermore, in accordance with an embodiment of the present invention, the directions of rotation of vacuum wheels of the plurality of vacuum wheels are parallel to one another.

Furthermore, in accordance with an embodiment of the present invention, in an arrangement of vacuum wheels of the plurality of vacuum wheels, each vacuum wheel of the arrangement is laterally rotated with respect to a neighboring vacuum wheel of the arrangement.

There is further provided, in accordance with an embodiment of the present invention, a support system for supporting and transporting a substrate, the system including: a plurality of idler wheels whose axes of rotation are parallel to one another; a plurality of vacuum wheels whose axes of rotation are parallel to the axes of rotation of the idler wheels, each vacuum wheel including: a fixed conduit that is connectable to a suction source; at least one vacuum surface on a circumference of the vacuum wheel, the vacuum surface including a plurality of vacuum openings that are distributed around the circumference, such that rotation of the wheel causes the vacuum openings of the plurality of vacuum openings to successively fluidically connect to the fixed conduit, such that, when suction is applied by the suction source to the fixed conduit, the suction is applied to one or more of the plurality of vacuum openings that are currently fluidly connected to the fixed conduit; and at least one contact surface on the circumference of the vacuum wheel, the at least one contact surface being adjacent to and extending outward beyond the vacuum surface such that, when the suction is applied to the one or more of the plurality of vacuum openings, the substrate is drawn toward the vacuum surface, so as to contact the at least one contact surface without contacting the vacuum surface, and so as to apply a friction force between the at least one contact surface and the substrate to transport the substrate when the wheel rotates.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1A:
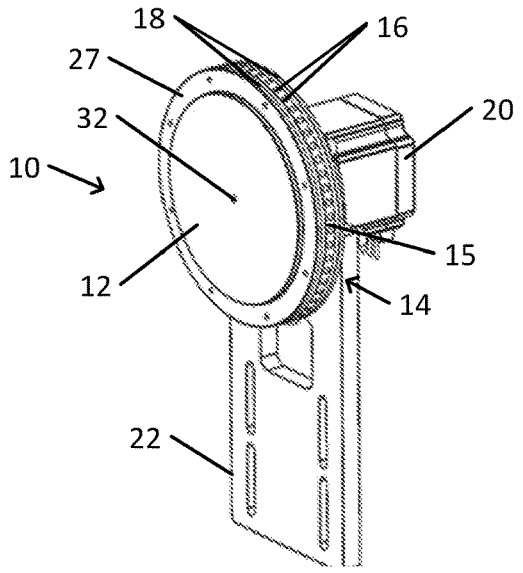
FIG. 1A schematically illustrates a vacuum wheel with separate contact and vacuum surfaces, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

In accordance with an embodiment of the present invention, a vacuum wheel includes a rim with one or more vacuum surface to which suction is applied. The suction may pull a flexible substrate toward the rim. One or more contact surfaces that are configured to come into physical contact with the flexible substrate extend radially outward from the rim beyond the vacuum surface.

The vacuum surface is located at the rim of the vacuum wheel and extends around the perimeter or circumference of the rim. The vacuum surface includes a plurality of vacuum openings through which suction may be applied to the vacuum openings. Application of the suction to the vacuum openings may be configured such that any particular time, suction is applied to the vacuum openings in one section whose azimuthal extent is less than the entire circumference of the vacuum surface.

For example, a fixed vacuum conduit may be located proximally to the rim. Suction from an external vacuum source may be applied to the fixed conduit. As the vacuum wheel is rotated, suction is applied to only those vacuum openings of the vacuum surface that are currently fluidically connected to (e.g., whose volumes are open to or contiguous with) the fixed conduit. The azimuthal extent of the section of the vacuum surface whose openings are concurrently fluidically connected to the fixed conduit (as determined by the azimuthal extent or width of the fixed conduit) is less than the entire circumference. For example, the azimuthal extent of the section may be wider than the azimuthal width of one of the vacuum openings. The azimuthal extent may be sufficiently small such that no more than two or three vacuum openings are concurrently fluidically connected to the fixed conduit. In some cases, the azimuthal extent of the section may be sufficient to enable more than two or three vacuum openings to be concurrently fluidically connected to the fixed conduit. Typically, the azimuthal extent of the section and fixed conduit is approximately equal to a region of a flexible substrate that is expected to be in concurrent contact with the contact surfaces. The size and distribution of the vacuum openings may be selected such that the total area of the vacuum openings to which suction is applied remains approximately constant as the vacuum wheel rotates.

Two contact surfaces may be arranged circumferentially around the rim on either side of each vacuum surface. Thus, the contact surfaces may be coaxial with the vacuum surface. The contact surfaces are raised from the rim relative to the vacuum surface. For example, each contact surfaces may be formed by a ring of material, e.g., an O-ring or other type of gasket, washer, or band (e.g., having a round, oval, polygonal, or otherwise shaped cross section) that may be placed around the rim of the ring. The rim may include a groove, indentation, or other structure that is configured to hold the ring in place. For example, the elasticity of the ring may hold the ring in the groove or other structure. A depth of the groove may be configured such that, when a particular type of ring is held in the groove, the exterior surface of the ring is at a predetermined distance from the vacuum surface. Alternatively or in addition, a contact surface in the form of a ring may be attached to the rim using an adhesive, pins, screws, or otherwise attached or caused to adhere to the rim surface.

For example, one or more vacuum wheels may be arranged on a noncontact support table of a noncontact support platform. An end of the rim of the vacuum wheel may extend out of an opening in the noncontact support table. An axis of the vacuum wheel, a motor for rotating the vacuum wheel, a vacuum source for applying suction to the vacuum openings of the vacuum source, or other components of the vacuum wheel or of a system that includes the vacuum wheel may be placed below the surface of the noncontact support table (e.g., to prevent contact of those components with a flexible substrate that is supported by the noncontact support platform).

In some cases, the system may include non-vacuum idler wheels. For example, each idler wheel may be configured to rotate freely about an axis. A rim of each idler wheel may include or may be covered with a material (e.g., rubber, silicone, a fluoroelastomer, urethane, polyurethane, polyether ether ketone, or another polymer or elastomer) that creates friction between the flexible substrate and the rim of the idler wheel. A plurality of idler wheels may be arranged in one or more longitudinal rows (e.g., parallel to the direction of transport) such that their axes of rotation are parallel to one another. Thus, friction between the plurality of parallel idler wheels and the flexible substrate may provide a counter-torque that resists any turning torque that may be applied by the vacuum wheels (e.g., due to small variations in substrate flatness, vacuum wheel rotational velocity, height, or coefficient of friction, or other variations).

Alternatively or in addition to vacuum wheels that are distributed on the surface of a noncontact support table, a noncontact support platform may be configured such that only part of the width (e.g., the substrate dimension that is perpendicular to the direction of transport of the flexible substrate) of the flexible substrate is supported by the noncontact support platform. In this case, wheels may be arranged on one or both lateral sides (e.g., substantially perpendicular to the direction of transport and to the longitudinal axis of the central region) of the noncontact support table. The wheels may be configured to support one or both lateral edges of the flexible substrate that extend laterally beyond the noncontact support platform. In some such cases, no vacuum wheels may be located within the noncontact support table, only on a lateral side of the noncontact support table.

In some cases, one or more regions of the noncontact support table may include a circular, arced, or other non-parallel arrangement of vacuum wheels that may be operated to rotate the flexible substrate. For example, a flexible substrate may be rotated at a junction or corner of a noncontact support platform or elsewhere where a direction of transport is to be changed. As another example, the flexible substrate may be rotated prior to performance of a manufacturing or testing process on the flexible substrate.

A flexible substrate may be supported by the noncontact support platform.

A noncontact support table of the noncontact support platform may be located above or below the flexible substrate. For example, a noncontact support platform that exhibits a fluidic spring effect may be configured to support the flexible substrate at a fixed distance from the noncontact support table, whether above or below the noncontact support table. Thus, when the location of a supported flexible substrate is herein described as being supported above the noncontact support table, it should be understood as applying also to when the noncontact support table is above the supported flexible substrate. The side of the noncontact support table that faces a flexible substrate that is supported by the noncontact support platform is herein referred to as the top of the noncontact support table. The space between the noncontact support table and the supported flexible substrate is herein referred to as above the noncontact support table and below the flexible substrate. Other directions relative to the noncontact support table and a flexible substrate that is supported by the noncontact support platform are also to be understood with reference to the above definitions of above and below.

When the flexible substrate is to be transported along the noncontact support platform, or otherwise (e.g., on vacuum wheels, or on an arrangement of vacuum wheels and idler wheels, that are positioned sufficiently close to one another such as to support the flexible substrate by themselves), one or more vacuum wheels that are located below the flexible substrate may be operated. A vacuum source may apply suction to the vacuum surface of each of the vacuum wheels. The suction that is thus applied to the vacuum openings of the vacuum surface may draw a part of the flexible substrate that is located above the vacuum wheel toward the vacuum surface. As the flexible substrate is drawn toward the vacuum surface, the flexible substrate may contact the contact surfaces that are adjacent to the vacuum surface.

When the flexible substrate is in contact with the contact surfaces, the region of contact between the contact surfaces and the flexible substrate may form a seal that partially surrounds the vacuum surface. For example, the seal may be formed in the region of tangency on the rim where the flexible substrate is approximately tangent to the contact surfaces. Thus, the suction in that region, e.g., the region of tangency, may be enhanced. The space between the flexible substrate and the contact surfaces may gradually increase as the distance along the rim of the vacuum wheel from the region of tangency increases.

The seal at the region of tangency may cause the suction within the partially surrounded region to be greater in that region than outside the region. As a result, friction between the flexible substrate and the vacuum wheel may be greatest at the region of tangency. The increased friction may facilitate propulsion of the flexible substrate by rotation of the vacuum wheel. On the other hand, the reduced suction outside of the region of tangency may facilitate rotation of the wheel without excessive bending or other disturbance of the flexible substrate.

A diameter of the vacuum wheel may be selected in accordance with one or more considerations. For example, increasing the diameter of each vacuum wheel reduces the local curvature of the wheel in the vicinity of contact between the flexible surface and the vacuum wheel. Thus, the size of the region of tangency may be increased, and the uniformity of the friction forces near at the region of tangency may be increased. On the other hand, rotation of a smaller vacuum wheel may be effected by a smaller or less powerful motor. In addition, a smaller vacuum wheel may occupy less space on a noncontact support table. Reducing the size of each vacuum wheel may enable increasing the number and density of vacuum wheels on a noncontact support table. Increasing the number or density of vacuum wheels may result in increased precision in transporting the flexible substrate. In some cases, a typical diameter of a vacuum wheel may be in the range of about 50 mm to about 250 mm.

Typically, sets of vacuum wheels may be arranged at various points along a noncontact support table. Selection of an arrangement of vacuum wheels may depend on such factors as an expected size of a typical flexible substrate, stiffness or flexibility of the flexible substrate (e.g., as determined by an elastic modulus of the substrate material), required accuracy of movement, speed of movement, or other factors.

An arrangement of vacuum wheels may be selected so as to limit or minimize rotational torque that is applied to the flexible substrate. Limiting rotational torques may enable accurate positioning and movement of the flexible substrate. For example, pairs of vacuum wheel may be arranged symmetrically with respect to a midline of the flexible substrate. Each vacuum wheel may be constructed in a symmetric manner (e.g., with two contact surfaces arranged symmetrically about each vacuum surface). Therefore, operation of the symmetrically arranged vacuum wheels may apply a linear force to the flexible substrate, e.g., that is parallel to one or more edges or axes of symmetry of the flexible substrate. Thus, the flexible substrate may be transported substantially along a straight line, without appreciable turning or application of appreciable torque when the flexible substrate is to be transported in a single direction. In some cases, a circular or other nonparallel arrangement of vacuum wheels may be provided to rotate the flexible substrate through a controllable angle, e.g., at a junction or corner where the direction of transport of the flexible substrate is to be changed.

Figure 1B:
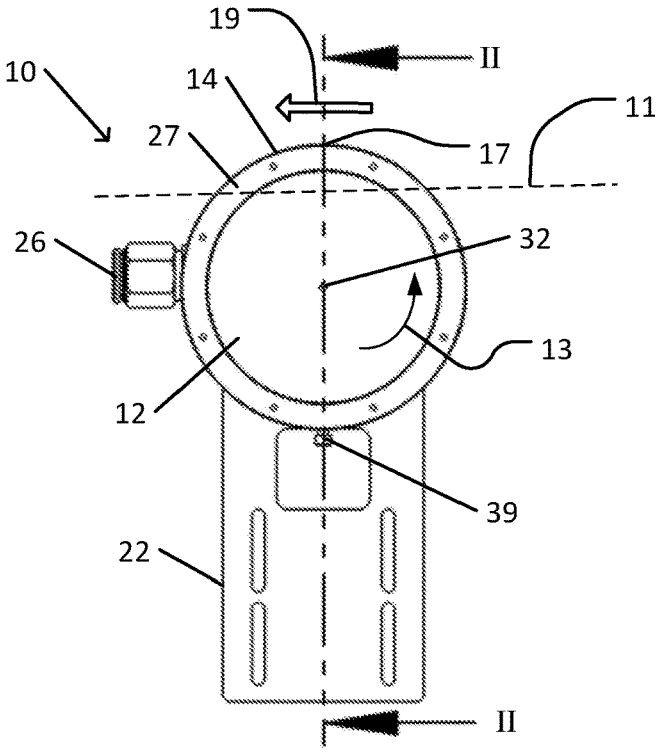
FIG. 1B is a schematic front view of the vacuum wheel shown in FIG. 1A.

FIG. 1A schematically illustrates a vacuum wheel with separate contact and vacuum surfaces, in accordance with an embodiment of the present invention. FIG. 1B is a schematic front view of the vacuum wheel shown in FIG. 1A.

Vacuum wheel assembly 10 includes wheel motor 20 that may be operated to rotate vacuum wheel 12 about its axis (as indicated by a visible exterior end of shaft bore 32). For example, wheel motor 20 may include an electrically powered motor or otherwise powered motor. A speed of rotation of wheel motor 20 may be controlled by a controller of a noncontact support system that includes vacuum wheel assembly 10.

In the example shown, a vacuum wheel assembly 10 includes a wheel motor 20. In the example shown, vacuum wheel 12 is directly rotated by (e.g., a hub of vacuum wheel 12 is mounted on a shaft of) wheel motor 20. Alternatively or in addition, one or more vacuum wheels 12 may be rotated by wheel motor 20 via a transmission. For example, a transmission may include one or more gears, belts, pulleys, or other components. In some cases, two or more vacuum wheels 12 may be connected by a transmission (e.g., by belts) to a single wheel motor 20.

Rotation of vacuum wheel 12 may apply a lateral force to a flexible substrate that is support by a noncontact support platform above wheel rim surface 14 on wheel rim 27 of vacuum wheel 12. The lateral force is in a direction of rotation of wheel rim surface 14 at a part of wheel rim surface 14 where a transported flexible substrate comes into contact with wheel rim surface 14. In the example, wheel motor 20 rotates vacuum wheel 12 in rotation direction 13. A flexible substrate that contacts wheel rim surface 14 at contact region 17 (shown as a single point in the schematic front view of FIG. 1B), may be propelled by a lateral force in transport direction 19.

Wheel rim surface 14 includes one or more vacuum surfaces 15. In the example shown, a single vacuum surface 15 is located at or near a midline of wheel rim surface 14.

Vacuum surface 15 includes a plurality of vacuum openings 16. Vacuum openings 16 may be arranged in single row, e.g., approximately along a midline of vacuum surface 15, as in the example shown. Alternatively or in addition, vacuum openings may be arranged otherwise on vacuum surface 15 (e.g., in several coaxial rows, in axially oriented rows that are parallel to an axis of rotation of vacuum wheel 12, in obliquely oriented rows that neither coaxial with vacuum surface 15 nor parallel to the axis of rotation of vacuum wheel 12, or otherwise). Typically, the distribution of arrangement of vacuum openings 16 is homogenous about the circumference of vacuum surface 15. For example, when vacuum openings 16 are arranged in a single row, as shown, the distance between pairs of adjacent vacuum openings 16 may be substantially constant for all pairs of adjacent vacuum openings 16.

Suction may be applied to vacuum openings 16 via suction port 26. For example, suction port 26 may be connected to a vacuum pump, blower, or another source of suction via one or more hoses, tubes, pipes, or other conduits. The suction source may be located, within a noncontact support table, or outside of the noncontact support table. In some cases, each vacuum wheel assembly 10 of a noncontact support table may be provided with a separate suction source. In this case, each suction source may be controlled in order to control the suction that is applied to vacuum openings 16 in each vacuum wheel assembly 10. In some cases, several or all vacuum wheel assemblies 10 of a noncontact support platform may be connected to a single suction source, e.g., via a manifold of conduits. In this case, suction to vacuum openings 16 of each vacuum wheel assembly 10 may be separately controlled by an arrangement of valves in the manifold. A typical value of a vacuum that is generated by the suction source may range from about 100 mbar to about 900 mbar, or more typically from about 200 mbar to about 600 mbar. Other vacuum levels may be provided. A selected vacuum level may depend on characteristics of a specific vacuum wheel assembly 10.

Contact surfaces 18 are raised outward from wheel rim surface 14 beyond vacuum surface 15. Contact surfaces 18 may be arranged symmetrically about, and adjacent to, vacuum surface 15. For example, one contact surface 18 may be located on each side of, and coaxial with, vacuum surface 15, with the other contact surface 18 located on the opposite side of vacuum surface 15. For example, two contact surfaces may be axially equidistant from a single row of vacuum openings 16 in vacuum surface 15.

In the case where wheel rim surface 14 includes more than one vacuum surface 15, a pair of contact surfaces 18 may be arranged adjacent to each vacuum surface 15.

Contact surfaces 18 may include a replaceable ring that encircles wheel rim surface 14. For example, a replaceable contact surface 18 may be replaced when contaminated, soiled, worn, or damaged.

For example, a replaceable contact surface 18 may include an O-ring, belt, band, or similar structure. Wheel rim surface 14 may be provided with a groove or other holding structure to hold a replaceable ring in place so as to form contact surface 18. Alternatively or in addition, a contact surface 18 may include a raised ridge that is integral to or permanently attached to (e.g., non-replaceable) wheel rim surface 14. Alternatively or in addition, a contact surface 18 in the form of a ring may be attached to wheel rim surface 14 using an adhesive, pins, or screws, or is otherwise attached or caused to adhere to wheel rim surface 14.

Each contact surface 18 is configured to apply a propelling force to a flexible substrate when vacuum wheel 12 is rotated and suction is applied to vacuum openings 16 of vacuum surface 15. Contact surface 18 may be constructed of a material with a coefficient of friction that is sufficient to enable application of the propelling force. The material may be selected in accordance with a type of flexible substrate, e.g., so as not to scratch, or otherwise damage or leave a residue on the flexible substrate. In some cases, contact surface 18 may also be sufficiently flexible and resilient so as to form a partial seal between contact surface 18 and the flexible substrate (e.g., so as to facilitate formation of suction in the region of the partial seal). Flexible materials may include, for example, rubber, silicone, a fluoroelastomer (synthetic rubber), urethane, polyurethane, polyether ether ketone (PEEK), or another polymer or elastomer.

Vacuum wheel assembly 10 may be attached to mounting structure 22. For example, mounting structure 22 may include one or more plates, brackets, or other structures. Mounting structure 22 may be configured to be mounted to one or more types of noncontact support tables, or to one or more other types of systems. Vacuum wheel assembly 10 may be attached to mounting structure 22 by one or more attachment elements 39. For example, attachment elements 39 may include bolts, screws, rivets, clips, latches, or other elements suitable for attaching vacuum wheel assembly 10 to mounting structure 22.

For example, vacuum wheel assembly 10 may be mounted within a noncontact support table such that most of the structure of vacuum wheel assembly 10 is located below table surface 11 of the noncontact support table. A part of vacuum wheel 12 that includes contact region 17 may extend out of (e.g., above) table surface 11. For example, contact region 17 may extend out of table surface 11 by a sufficient distance so as to facilitate transport of a flexible substrate by rotation of vacuum wheel 12.

Figure 2A:
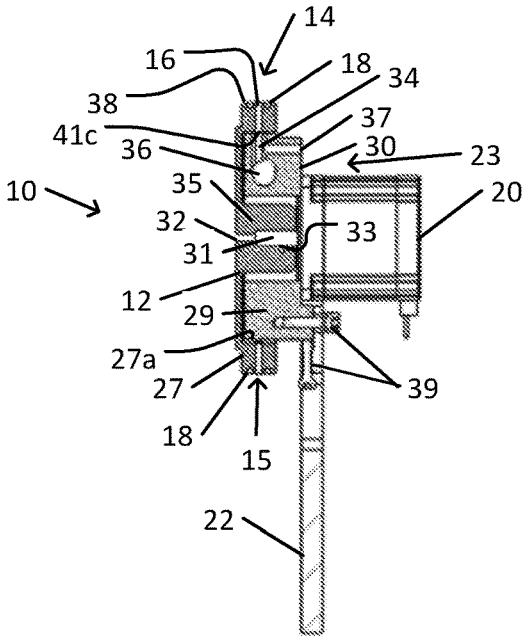
FIG. 2A is a schematic cross sectional view of the vacuum wheel shown in FIG. 1B.

FIG. 2A is a schematic cross sectional view of the vacuum wheel shown in FIG. 1B. The schematic cross section shown in FIG. 2A corresponds to cross section indicated as cross section II in FIG. 1B.

Wheel motor 20 is configured to rotate motor shaft 31. Motor shaft 31 may be inserted into shaft bore 32 in wheel hub 35 of vacuum wheel 12. In the example shown, an exterior end of shaft bore 32 is open to the atmosphere. The opening may facilitate insertion of motor shaft 31 into shaft bore 32 when assembling vacuum wheel assembly 10, or removal of motor shaft 31 from shaft bore 32 when disassembling vacuum wheel assembly 10.

Shaft bore 32 in wheel hub 35 may be secured to motor shaft 31 by one or more set screws that may be inserted via one or more set screw openings 33 in vacuum wheel 12. Set screw openings 33 may be accessed by via one or more bores within vacuum wheel 12 (e.g., out of the plane of the cross section shown in FIG. 2A).

Alternatively or in addition, one or more other mechanisms may be utilized to secure vacuum wheel 12, e.g., wheel hub 35 of vacuum wheel 12, to wheel motor 20. For example, vacuum wheel 12 may be provided with an axle that is insertable into a socket of wheel motor 20, or an axle or shaft may be inserted into sockets in both vacuum wheel 12 and wheel motor 20. A one or both of a shaft and a bore or socket may include threading. A shape of a shaft and a bore or socket may deviate in a cooperating manner from cylindrical symmetry (e.g., may be polygonal, oval, may include cooperating ridges and grooves, or may otherwise device from cylindrical symmetry). A shaft may be secured to a bore by one or more nuts, pins, clips, latches, adhesives, or other structure.

Vacuum wheel 12 is configured to rotate relative to fixed vacuum wheel structure 23. For example, a central part of fixed vacuum wheel structure 23 may form a hollow cavity within which wheel hub 35 of vacuum wheel 12 may rotate. Wheel rim 27 of vacuum wheel 12 may surround, and rotate around, fixed vacuum wheel structure 23.

A part of fixed vacuum wheel structure 23, e.g., that typically is located below the surface of a noncontact support table, may include mounting section 29. For example, mounting section 29 may be mounted to mounting structure 22 (e.g., a metal plate or other appropriate structure) using attachment elements 39.

An upper part of fixed vacuum wheel structure 23 forms vacuum structure 30 for applying suction to vacuum surface 15. As vacuum wheel 12 rotates, wheel rim 27 rotates about vacuum structure 30. Thus, different regions of vacuum surface 15 on wheel rim surface 14 may be successively brought to be adjacent to vacuum structure 30. As a region of vacuum surface 15 is brought to be adjacent to vacuum structure 30, suction may be applied by vacuum structure 30 to vacuum openings 16 in that region of vacuum surface 15.

Figure 2B:
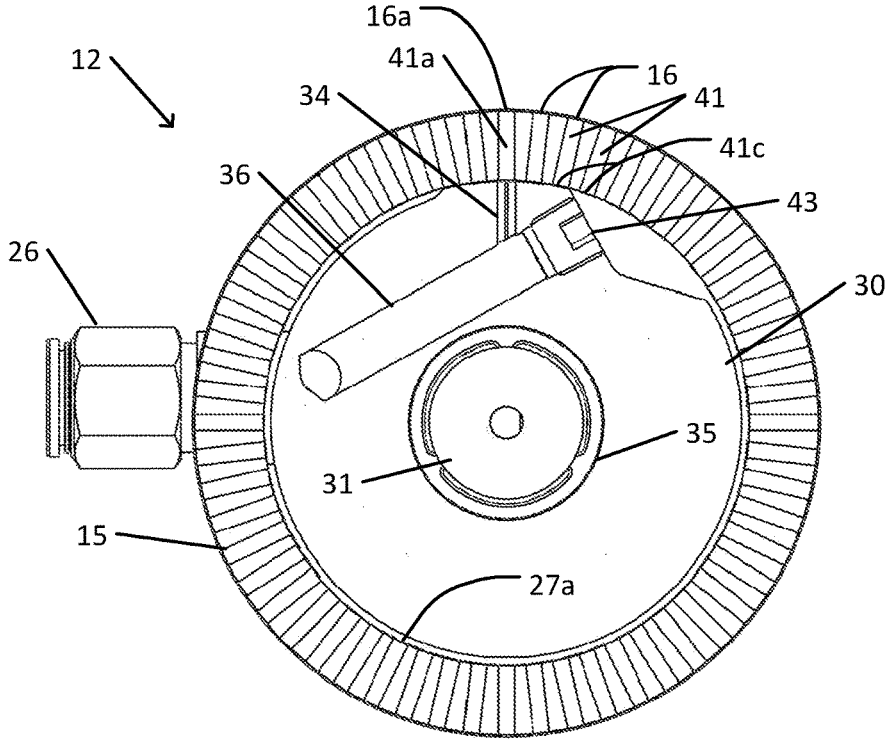
FIG. 2B schematically illustrates interior structure of the vacuum wheel shown in FIG. 1A.

FIG. 2B schematically illustrates interior structure of the vacuum wheel shown in FIG. 1A.

Vacuum structure 30 includes suction source conduit 36 that is fluidically connected to suction port 26. In the example shown, an end of suction source conduit 36 (e.g., an end where a bore was made in a block of material to form suction source conduit 36) may be closed by conduit stopper 43. In other examples (e.g., where suction source conduit 36 is formed by other techniques), suction source conduit 36 may be otherwise closed off from the ambient atmosphere. When suction port 26 is connected to a suction source, a suction that is generated by the suction source may be applied via suction port 26 to suction source conduit 36.

Suction source conduit 36 is fluidically connected to fixed vacuum conduit 34 of vacuum structure 30. Fixed vacuum conduit 34 is configured to apply the suction to vacuum surface 15 in a region of wheel rim surface 14 that is expected to be in contact with a flexible substrate. For example, fixed vacuum conduit 34 may connect suction source conduit 36 to a (currently) uppermost section of vacuum surface 15.

Vacuum openings 16 may be distributed about the circumference of vacuum surface 15. Each vacuum opening 16 is fluidically connected to a vacuum conduit 41 in wheel rim 27. Each vacuum conduit 41 extends from a vacuum opening 16 on an outer surface of wheel rim 27 to inner end 41*c* on inner surface 27*a* of wheel rim 27. Rotation of wheel rim 27 about vacuum structure 30 brings each inner end 41*c* of each vacuum conduit 41 on wheel rim 27 successively to fixed vacuum conduit 34. When an inner end 41*c* of a vacuum conduit 41 is adjacent to fixed vacuum conduit 34, such as vacuum conduit 41*a* in the example shown, suction may be applied to that vacuum conduit 41*a* and to the vacuum opening 16*a* at the outer end of that vacuum conduit 41*a*.

Dimensions of vacuum conduits 41 and of fixed vacuum conduit 34 may be configured to enable two or more vacuum conduits 41 to be fluidically connected concurrently to fixed vacuum conduit 34.

Figure 2C:
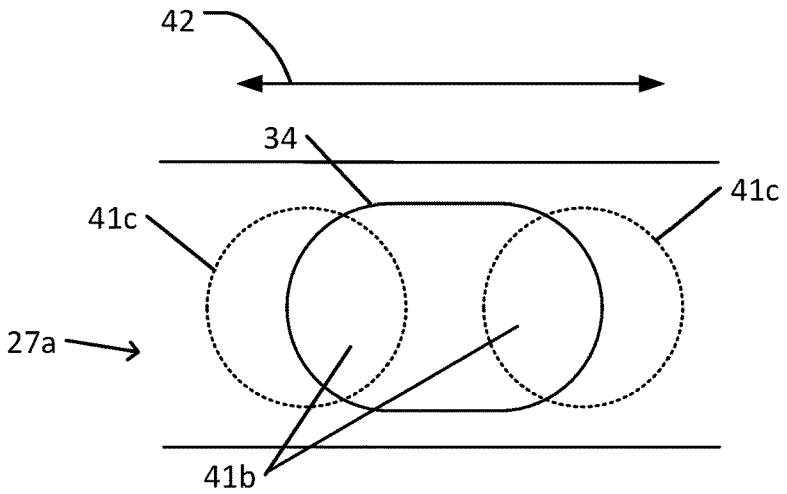
FIG. 2C schematically illustrates two vacuum conduits of the vacuum wheel shown in FIG. 2B that are concurrently fluidically connected to a fixed vacuum conduit.

FIG. 2C schematically illustrates two vacuum conduits of the vacuum wheel shown in FIG. 2B that are concurrently fluidically connected to the fixed vacuum conduit of the vacuum wheel.

Typically, fixed vacuum conduit 34 may an azimuthal extent in azimuthal direction 42 (e.g., parallel to the direction of rotation of vacuum wheel 12) than the azimuthal extent of inner end 41*c* of each vacuum conduit 41. For example, the shape of the cross section of fixed vacuum conduit 34 may be in the form of an elongated circle or rounded rectangle (e.g., as in the example shown) whose azimuthal extent in azimuthal direction 42 is greater than its width in the axial direction (e.g., perpendicular to azimuthal direction 42 and parallel to the rotation axis of vacuum wheel 12). The azimuthal extent of fixed vacuum conduit 34 may be sufficient so as to ensure that at all times during rotation of wheel rim 27 and vacuum surface 15, at least part of inner end 41*c* of at least one vacuum conduit 41 is always fluidically connected to fixed vacuum conduit 34. Ensuring that at least one vacuum conduit 41 is always fluidically connected to fixed vacuum conduit 34 may limit variations in a suction force that is applied to a flexible substrate that is being transported by vacuum wheel 12. In particular, ensuring that at least one vacuum conduit 41 is always fluidically connected to fixed vacuum conduit 34 may ensure approximately uniform and constant suction flow in the volume that is bounded by vacuum surface 15, the flexible substrate, and contact surfaces 18. In some cases, the dimensions of vacuum conduits 41 and of fixed vacuum conduit 34 may be configured such that the overlap area 41*b* (e.g., indicating the total area of inner ends 41*c* of vacuum conduits 41 that is currently fluidically connected to fixed vacuum conduit 34) is approximately constant as vacuum wheel 12 rotates.

Although in the example shown, vacuum conduits 41 are shown with a circular cross section, the shape of the cross section of a vacuum conduit 41, of vacuum opening 16, or both, may be oval, polygonal, or otherwise noncircular.

In some cases, an axial dimension of fixed vacuum conduit 34 may be wider than an axial dimension of vacuum conduit 41. In some cases, two or more vacuum openings 16 may be fluidically connected to a common vacuum conduit.

In some cases, vacuum structure 30 may include an access bore 37. For example, access bore 37 may be utilized for inserting a sensor for monitoring pressure or other properties of air or another fluid within fixed vacuum conduit 34 or elsewhere within vacuum structure 30. When no sensor is inserted into access bore 37, access bore 37 may be closed or sealed with an appropriate plug, cover, sealant, or otherwise.

Figure 3:
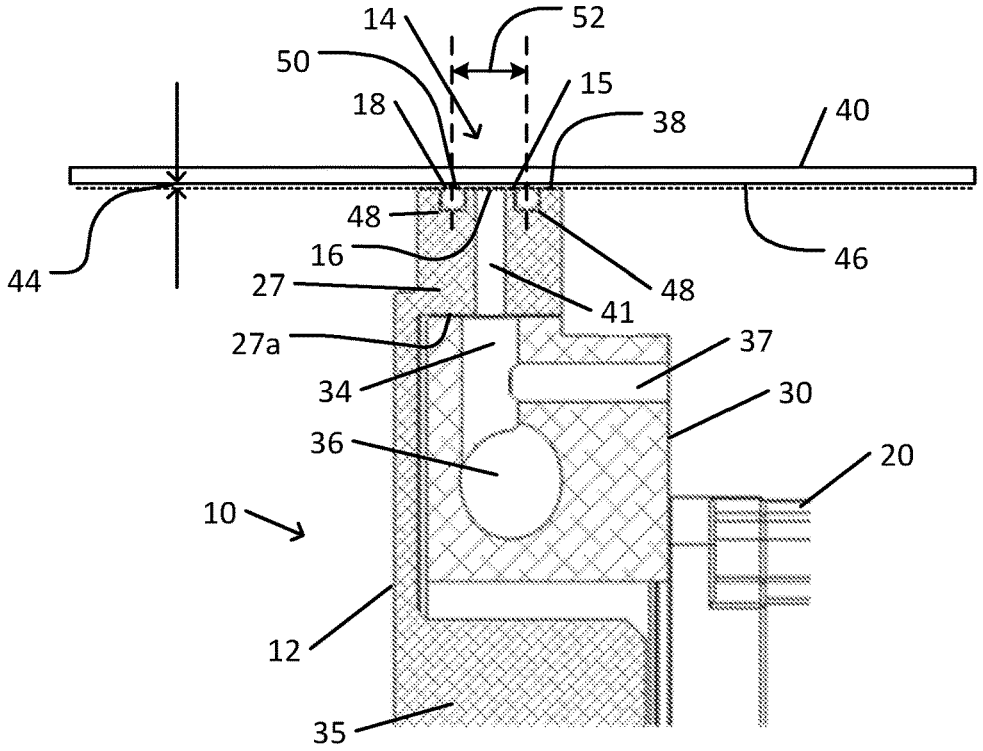
FIG. 3 shows an enlargement of the vacuum wheel cross section shown in FIG. 2A with a transported flexible substrate.

FIG. 3 shows an enlargement of the vacuum wheel cross section shown in FIG. 2A with a transported flexible substrate.

In the example shown, each contact surface 18 is in the form of an O-ring. Each O-ring that forms a contact surface 18 is held within an O-ring groove 48. A depth of 0-ring groove 48 may be configured such that contact surface 18 extends outward from vacuum surface 15 by a distance 44. In the example shown, distance 44 is measured between line 46, indicating radial position of vacuum surface 15 (and, in the example shown, of exterior rim surface 38), and the top of contact surface 18. Alternatively or in addition, other holding structure may be provided for holding a replaceable contact surface 18 in the form of an O-ring or another form.

For example, distance 44 may be selected to be small enough such that excessive suction is not required to hold flexible substrate 40 to contact surface 18. Similarly, distance 44 may be sufficiently large so as to prevent direct contact between flexible substrate 40 (which may bend inward toward vacuum surface 15) and vacuum surface 15 (e.g., so as to prevent non-uniform suction forces due to contact of flexible substrate 40 with vacuum opening 16, so as to prevent possible damage to flexible substrate 40, or to enable precise control of transport of flexible substrate 40). For example, distance 44 may range from about 50 μm to about 1000 μm, or in some cases, in the range of about 100 μm to about 500 μm. Distance 44 may have other values.

When a vacuum conduit 41 is rotated to fixed vacuum conduit 34, suction may be applied to vacuum opening 16 that is fluidically connected to that vacuum conduit 41. A flexible substrate 40 may be supported, e.g., by a noncontact support platform that fully or partially surrounds vacuum wheel 12. Suction that is applied to vacuum opening 16 may draw flexible substrate 40 toward vacuum surface 15.

As flexible substrate 40 is drawn toward vacuum surface 15, flexible substrate 40 may come into contact with contact surfaces 18 at a contact point 50. (Although, in the example shown, flexible substrate 40 is shown as flat, a typical flexible substrate 40 may bend in response to suction forces, may have a pre-existing bend, or may bend in response to other forces.) A partial seal that reduces inflow of air may be formed at contact point 50. Thus, suction may be enhanced in suction region 52 between contact points 50. The width of wheel rim 27 and of suction region 52 may be selected to be sufficiently small so as to ensure that inward bulging of flexible substrate 40 between contact surfaces 18 is sufficiently small such that flexible substrate 40 does come into direct physical contact with vacuum surface 15. On the other hand, the width of suction region 52 may be configured to be sufficiently large such that the area to which suction is applied, and thus the inward normal force that is applied to flexible substrate 40 due to the difference in air pressure inside and outside of flexible substrate 40 (the force being equal to the product of the pressure difference and the area to which the pressure difference is applied), is sufficient to hold flexible substrate 40 in contact with contact surfaces 18. For example, the width of suction region 52 may range from about 5 mm to about 50 mm. The width of suction region 52 may have other values.

A plurality of vacuum wheel assemblies 10 may be incorporated into a noncontact support table that is configured to generate a noncontact support platform. Alternatively or in addition, the vacuum wheels, or on an arrangement of vacuum wheels and idler wheels (e.g., where the vacuum and or idler wheels are positioned sufficiently close to one another), may be configured to support the flexible substrate in the absence of a noncontact support platform.

Figure 4:
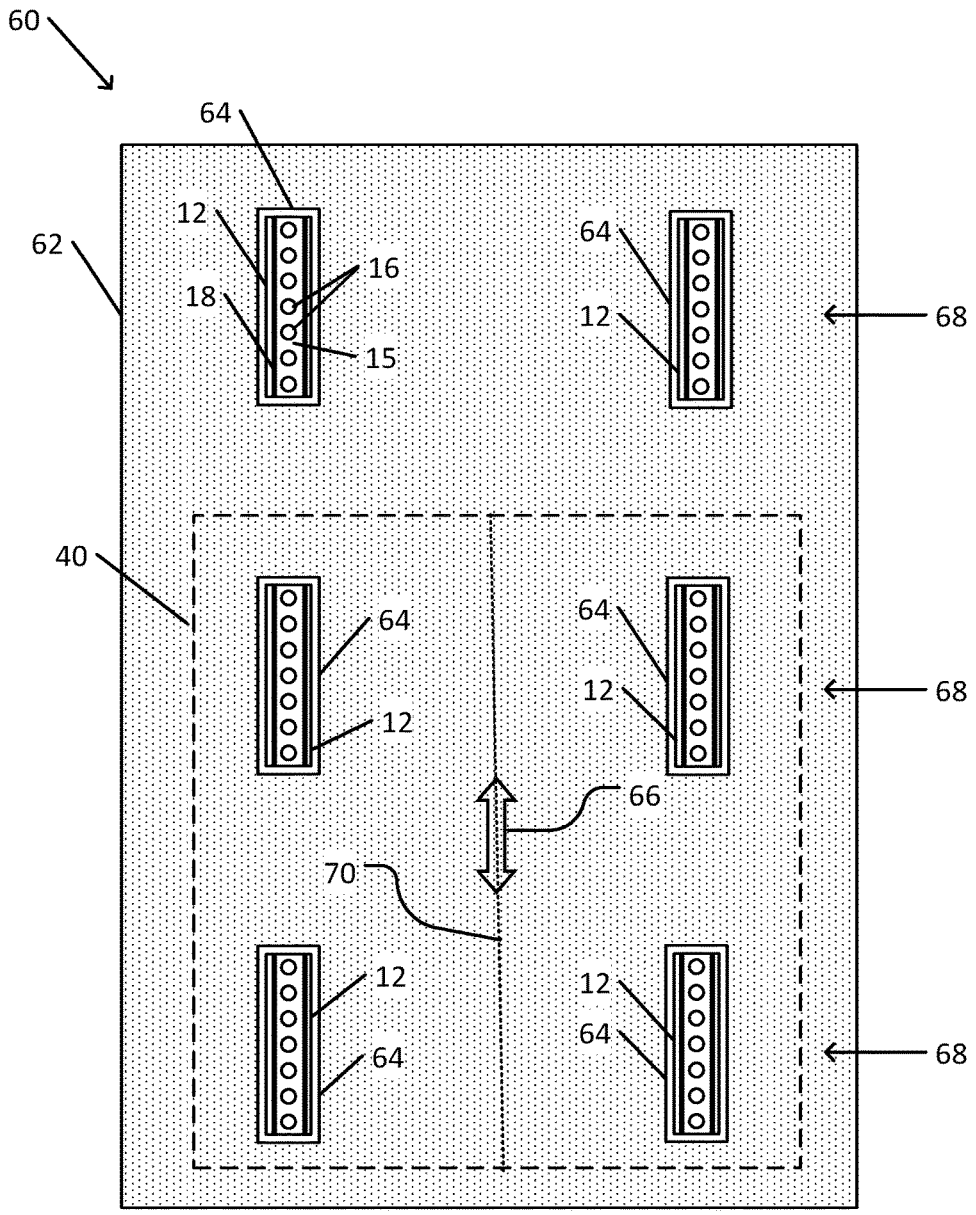
FIG. 4 schematically illustrates a noncontact support table incorporating the vacuum wheels shown in FIG. 1A.

FIG. 4 schematically illustrates a noncontact support table incorporating the vacuum wheels shown in FIG. 1A.

Noncontact support platform system 60 is configured to support and transport a flexible substrate 40 with minimal physical contact.

A noncontact support table 62 of noncontact support platform system 60 is configured to generate a noncontact support platform. For example, a plurality of pressure ports may be distributed on the surface of noncontact support table 62. For example, each pressure port may be connected to a pressure source (e.g., to a manifold that is connected to the pressure source). Vacuum ports may be distributed among the pressure ports. For example, each vacuum port may be connected to a vacuum source (e.g., to a manifold that is connected to a vacuum source). In some cases, the pressure and vacuum ports may be configured to create a fluidic spring effect. A fluidic spring effect may be configured to support flexible substrate 40 at a fixed distance from the surface of noncontact support table 62.

Noncontact support table 62 includes a plurality of wheel openings 64. A vacuum wheel 12 may be mounted within some or all of wheel openings 64. For example, a vacuum wheel assembly 10 may be mounted to noncontact support table 62, e.g., using mounting structure 22, such that an upper portion of its vacuum wheel 12 extends out of a wheel opening 64.

In the example shown, all of wheel openings 64 and vacuum wheels 12 are oriented parallel to one another. Thus, operation of vacuum wheels 12 may transport flexible substrate 40 in the direction indicated by double arrow 66. Suction may be applied to vacuum openings 16 on vacuum surface 15 of each operating vacuum wheel 12 as that vacuum wheel 12 is rotated on its axis (perpendicular to double arrow 66). The applied suction may draw flexible substrate 40 toward contact surfaces 18. The resulting increase in friction between flexible substrate 40 and contact surfaces 18 may facilitate transport of flexible substrate 40 by rotation of vacuum wheel 12.

In other arrangements, some of vacuum wheels 12 may be oriented perpendicular to, or at an oblique angle to, other vacuum wheels 12. For example, differently oriented vacuum wheels 12 may be operated to transport flexible substrate 40 in different directions. In some cases, mounting of a vacuum wheel assembly 10 to noncontact support table 62 may enable raising or lowering a vacuum wheel 12. For example, those vacuum wheels 12 that are oriented (e.g., whose direction of rotation is oriented) parallel to an intended direction of transport of flexible substrate 40 motion may be raised. When a vacuum wheel 12 is raised, application of suction to vacuum openings 16 on vacuum surface 15 may increase in friction between flexible substrate 40 and contact surfaces 18 to facilitate transport of flexible substrate 40. Those vacuum wheels 12 that are not oriented parallel to the intended direction of transport may be lowered. Lowering of the vacuum wheels 12 that are not oriented parallel to the direction of transport may prevent interference of those vacuum wheels 12 with transport of flexible substrate 40.

In the example shown, pairs of vacuum wheels 12 are arranged in rows 68. In some cases, more than two parallel vacuum wheels 12 may be arranged in a single row 68. The vacuum wheels 12 in a row 68 may be arranged such that vacuum wheels 12 are arranged laterally symmetrically with respect to an expected lateral position (e.g., in a direction that is substantially perpendicular to a direction of transport, e.g., as indicated by double arrow 66). For example, vacuum wheels 12 in a single row 68 such that pairs of vacuum wheels 12 that are on different sides of midline 70 (e.g., that is parallel to the direction of transport indicated by double arrow 66) of flexible substrate 40 are equidistant from midline 70.

Typically, vacuum wheels 12 in a single row 68 may be substantially identical with one another and may be operated in tandem. For example, when operated in tandem, all vacuum wheels 12 in a single row 68 may be rotated at substantially the same speed of rotation, and substantially identical suction may be applied to vacuum openings 16 of all vacuum wheels 12 in that row 68.

In one example, the transporting force that is applied to a flexible substrate 40 by a pair of vacuum wheels 12 (e.g., dependent on materials, parameters of operation, and other factors) may range from about 100 gram-force to about 2000 gram-force. Increasing the number of vacuum wheels 12 in each row 68 may enable increasing the range of forces. Similarly, the total transporting force that is applied to a flexible substrate 40 may depend on the number of rows 68 that are concurrently covered by that flexible substrate 40. For example, when flexible substrate 40 covers two rows 68, as in the example shown, the transporting force applied to flexible substrate 40 may be greater than the force that would be applied to a similarly constructed substrate that covers one row 68. Similarly, the transporting force that is applied to flexible substrate 40 covering two rows 68, as shown, may be less than the force that would be applied to a similarly constructed substrate that covers three or more rows 68.

Symmetric arrangement of at least two vacuum wheels 12 with respect to midline 70 of flexible substrate 40, together with tandem operation of the symmetrically arranged vacuum wheels 12, may reduce or eliminate application of turning torques (e.g., yaw) to flexible substrate 40. Thus, transport of flexible substrate 40 may be precisely controlled.

In other cases, (e.g., when transporting a narrow flexible substrate 40, or when possible application of a turning torque is not considered to be problematic), each row 68 may include a single vacuum wheel 12. In such a case, for example, the vacuum wheels 12 in the different rows 68 may be linearly aligned with one another, e.g., substantially along midline 70 of flexible substrate 40. In another example, vacuum wheels 12 in different rows 68 may be arranged such that a turning torque that is applied by one vacuum wheel 12 may be opposed by a substantially equal and opposite turning torque that is applied by another vacuum wheel 12.

Vacuum wheels 12 may be arranged otherwise on a noncontact support table.

Figure 5A:
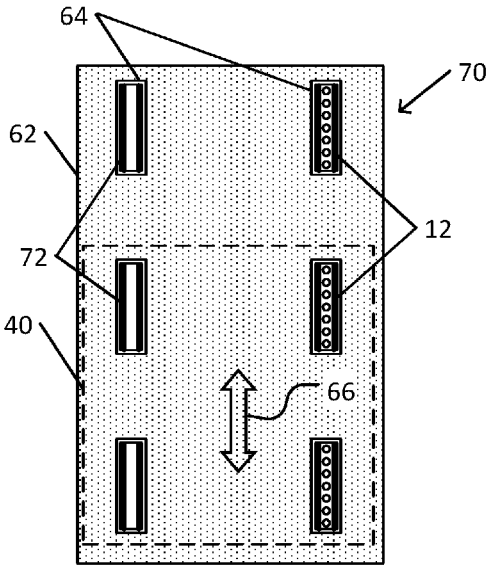
FIG. 5A schematically illustrates a noncontact support table incorporating the vacuum wheels shown in FIG. 1A and idler wheels.

FIG. 5A schematically illustrates a noncontact support table incorporating the vacuum wheels shown in FIG. 1A and idler wheels.

In noncontact support platform system 70, some of wheel openings 64 include idler wheels 72. For example, and idler wheel 72 may be unpowered and may be mounted on bearings that enable idler wheel 72 to rotate freely about its axis when a tangential force is applied to its rim. On the other hand, the rim of idler wheel 72 may be configured to create friction between flexible substrate 40 and idler wheel 72. The friction may prevent lateral sliding of flexible substrate 40 relative to idler wheel 72. Thus, flexible substrate 40 may be confined to move only in the direction in which idler wheel 72 is enabled to rotate, e.g., parallel to the direction indicated by double arrow 66. Therefore, a noncontact support platform system 70 that incorporates idler wheels 72 may require fewer vacuum wheels 12 than a system (e.g., noncontact support platform system 60) that does not include idler wheels 72.

In the example shown, idler wheels 72 are arranged in a single row that is parallel to another single row of vacuum wheels 12. Alternatively or in addition, vacuum wheels 12 and idler wheels 72 may be otherwise arranged. In such an alternative or additional arrangement, the directions of rotation of vacuum wheels 12 and idler wheels 72 may be parallel to one another and to the direction of transport of flexible substrate 40 that is indicated by double arrow 66.

In some cases, vacuum wheels 12 may be located next to noncontact support table 62, rather than in wheel openings 64 within the surface of noncontact support table 62.

Figure 5B:
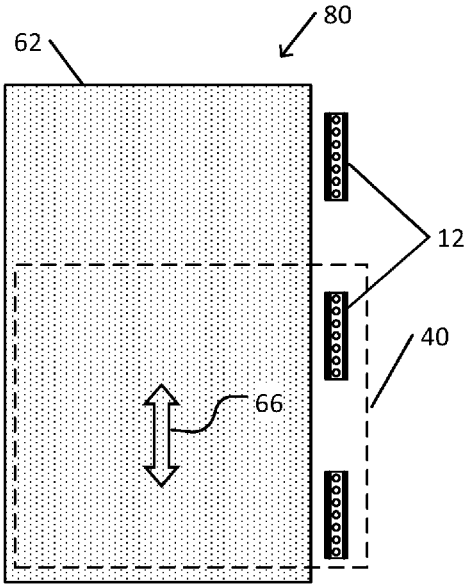
FIG. 5B schematically illustrates a noncontact support table with vacuum wheels as shown in FIG. 1A next to the table.

FIG. 5B schematically illustrates a noncontact support table with vacuum wheels as shown in FIG. 1A next to the table.

In noncontact support platform system 80, vacuum wheels 12 are arranged adjacent to noncontact support table 62. Vacuum wheels 12 are arranged such that a wheel rim 14 of each vacuum wheel 12 extends above (e.g., beyond, toward flexible substrate 40) the surface of noncontact support table 62.

Although vacuum wheels 12 are shown in a single row on one side of noncontact support table 62, an alternative noncontact support platform system 80 may include vacuum wheels 12 that are arranged otherwise. For example, vacuum wheels 12 may be arranged on both sides of noncontact support table 62 (e.g., symmetrically or otherwise), in more than one row, or otherwise (e.g., with the directions of rotation of vacuum wheels 12 parallel to one another and to the direction of transport of flexible substrate 40 that is indicated by double arrow 66).

Figure 5C:
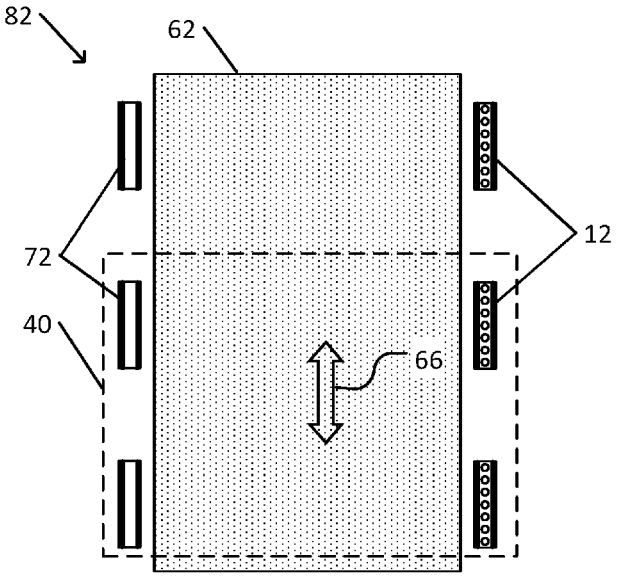
FIG. 5C schematically illustrates the noncontact support table shown in FIG. 5B with idler wheels on one side of the table.

FIG. 5C schematically illustrates the noncontact support table shown in FIG. 6B with idler wheels on one side of the table.

In noncontact support platform system 82, idler wheels 72 are arranged adjacent to noncontact support table 62, in addition to vacuum wheels 12. In the example shown, idler wheels 72 are arranged in a single row that is parallel to another single row of vacuum wheels 12. Alternatively or in addition, vacuum wheels 12 and idler wheels 72 may be otherwise arranged. In such an alternative or additional arrangement, the directions of rotation of vacuum wheels 12 and idler wheels 72 may be parallel to one another and to the direction of transport of flexible substrate 40 that is indicated by double arrow 66.

In some cases, or on part of a noncontact support table 62, vacuum wheels 12 may be arranged to rotate a flexible substrate 40.

Figure 6:
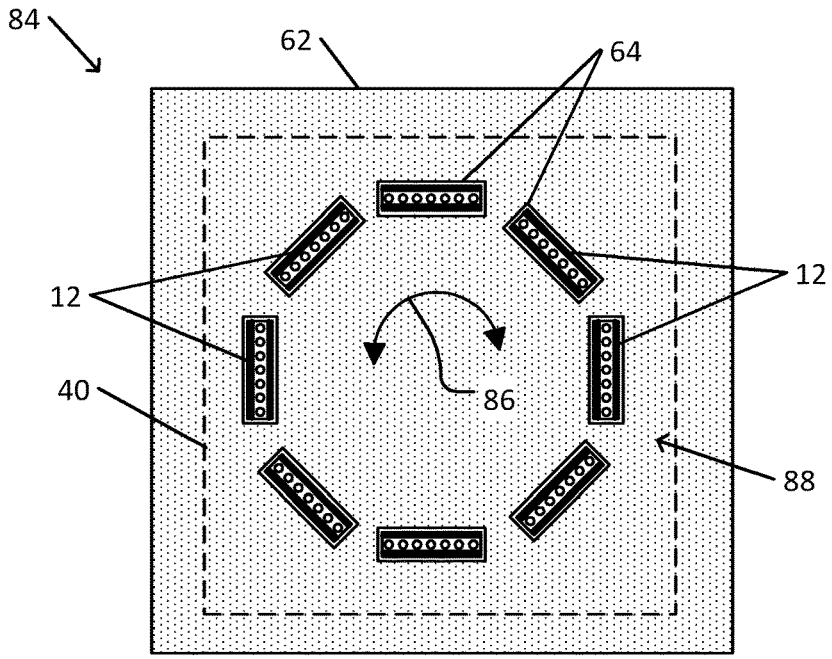
FIG. 6 schematically illustrates a noncontact support table with vacuum wheels as shown in FIG. 1A arranged to rotate a substrate.

FIG. 6 schematically illustrates a noncontact support table with vacuum wheels as shown in FIG. 1A arranged to rotate a substrate.

In noncontact support platform system 84, vacuum wheels 12 are arranged in wheel arrangement 88 that is configured to laterally rotate flexible substrate 40. In wheel arrangement 88, a plurality of vacuum wheels 12 are arranged such that each vacuum wheel 12 is rotated at an angle relative to its neighboring vacuum wheels 12 in arrangement 88. In some cases, the angle between each pair of neighboring vacuum wheels 12 of wheel arrangement 88 may be the same for all such pairs of neighboring vacuum wheels 12. For example, wheel arrangement 88 may be approximately octagonal, as in the example shown for eight vacuum wheels 12, or have another arrangement (e.g., for a wheel arrangement 88 of a number of vacuum wheels 12 that is more or less than eight). In some cases, the axes of rotation of all vacuum wheels 12 may intersect approximately at a single point.

In order to rotate flexible substrate 40, all of vacuum wheels 12 may be rotated concurrently in a single rotation direction, e.g., as defined relative to a radius from the center of wheel arrangement 88 and through the radius of each vacuum wheel 12 in wheel arrangement 88. (In some cases, e.g., when wheel arrangement 88 includes a large number of vacuum wheels 12, of the vacuum wheels 12, or idler wheels 72, may be allowed to rotate freely.) When vacuum wheels 12 of wheel arrangement 88 are rotated in a single direction, flexible substrate 40 may be rotated in a rotation direction 86.

In some cases, a flexible substrate 40 may be supported and transported by an arrangement of vacuum wheels 12 and idler wheels 72, without a noncontact support table 62.

Figure 7:
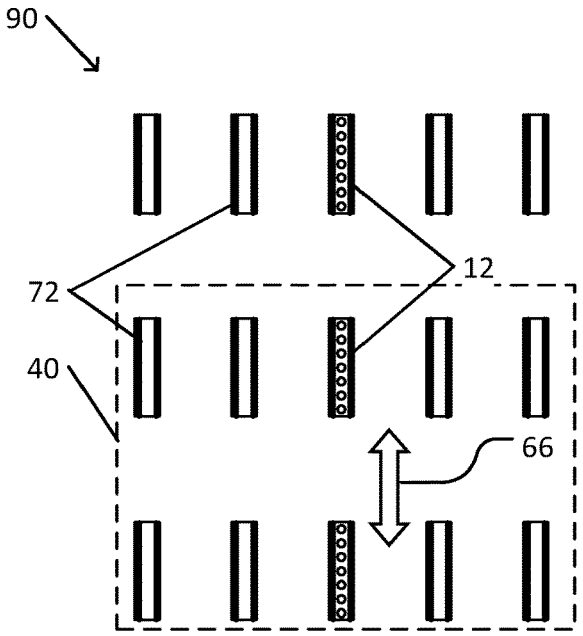
FIG. 7 schematically illustrates a substrate transport system with vacuum wheels and idler wheels, in accordance with an embodiment of the present invention.

FIG. 7 schematically illustrates a substrate transport system with vacuum wheels and idler wheels, in accordance with an embodiment of the present invention.

In support system 90, a flexible substrate 40 is supported by an arrangement of idler wheels 72 and vacuum wheels 12. In the example shown, a single row of vacuum wheels 12 is arranged among parallel rows of idler wheels 72. Alternatively or in addition, vacuum wheels 12 and idler wheels 72 may be otherwise arranged. In such an alternative or additional arrangement, the directions of rotation of vacuum wheels 12 and idler wheels 72, as well as their axes of rotation, may be parallel to one another and to the direction of transport of flexible substrate 40 that is indicated by double arrow 66.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A vacuum wheel for transporting a substrate, the vacuum wheel comprising:

a fixed conduit that is connectable to a suction source;

at least one vacuum surface on a circumference of the vacuum wheel, the vacuum surface including a plurality of vacuum openings that are distributed around the circumference, such that rotation of the wheel causes vacuum openings of said plurality of vacuum openings to successively fluidically connect to the fixed conduit such that when suction is applied by the suction source to the fixed conduit, suction is applied to one or more of said plurality of vacuum openings that are currently fluidically connected to the fixed conduit; and at least one contact surface on the circumference of the vacuum wheel, said at least one contact surface being adjacent to and extending outward beyond the vacuum surface such that, when the suction is applied to said one or more of said plurality of vacuum openings, the substrate is drawn toward the vacuum surface, so as to contact said at least one contact surface without contacting the vacuum surface, and so as to apply a friction force between said at least one contact surface and the substrate to transport the substrate when the wheel rotates.

2. The vacuum wheel of claim 1, wherein said plurality of vacuum openings are arranged in a single row.

3. The vacuum wheel of claim 2, wherein a distance between a pair of adjacent vacuum openings of said plurality of vacuum openings is substantially constant.

4. The vacuum wheel of claim 1, wherein each of said plurality of vacuum openings is connected via a vacuum conduit to an inner surface of a rim of the vacuum wheel.

5. The vacuum wheel of claim 1, wherein an azimuthal extent of the fixed conduit is longer than a width of the fixed conduit in an axial direction.

6. The vacuum wheel of claim 5, wherein the azimuthal extent of the fixed conduit is sufficient such that at least one of said plurality of vacuum openings is always fluidically connected to the fixed conduit as the vacuum wheel rotates.

7. The vacuum wheel of claim 1, wherein said at least one contact surface comprises two contact surfaces, wherein the two contact surfaces are located on opposite sides of the vacuum surface.

8. The vacuum wheel of claim 7, wherein the two contact surfaces are equidistant from the vacuum openings of the vacuum surface.

9. The vacuum wheel of claim 1, wherein a contact surface of said plurality of contact surfaces is replaceable.

10. The vacuum wheel of claim 9, wherein the replaceable contact surface comprises an O-ring.

11. The vacuum wheel of claim 9, wherein a rim of the vacuum wheel comprises holding structure for holding the replaceable contact surface in place.

12. The vacuum wheel of claim 11, wherein the holding structure comprises a groove.

13. The vacuum wheel of claim 1, further comprising a motor for rotating the vacuum wheel.

14. A support table for supporting and transporting a substrate, the table comprising:

a plurality of pressure ports that are distributed across a surface of the table;

a plurality of vacuum wheels, each of the vacuum wheels being mounted to the table such that an end of each of the vacuum wheels extends beyond the table surface, each vacuum wheel comprising:

a fixed conduit that is connectable to a suction source;

at least one vacuum surface on a circumference of the vacuum wheel, the vacuum surface including a plurality of vacuum openings that are distributed around the circumference, such that rotation of the wheel causes the vacuum openings of said plurality of vacuum openings to successively fluidically connect to the fixed conduit such that, when suction is applied by the suction source to the fixed conduit, the suction is applied to one or more of said plurality of vacuum openings that are currently fluidly connected to the fixed conduit; and at least one contact surface on the circumference of the vacuum wheel, said at least one contact surface being adjacent to and extending outward beyond the vacuum surface such that, when the suction is applied to said one or more of said plurality of vacuum openings, the substrate is drawn toward the vacuum surface, so as to contact said at least one contact surface without contacting the vacuum surface, and so as to apply a friction force between said at least one contact surface and the substrate to transport the substrate when the wheel rotates.

15. The support table of claim 14, wherein the table comprises a plurality of wheel openings, and the end of each of the vacuum wheels extends beyond the table surface through a wheel opening of said plurality of wheel openings.

16. The support table of claim 14, wherein vacuum wheels of said plurality of vacuum wheels are arranged adjacent to the table surface.

17. The support table of claim 14, further comprising a plurality of idler wheels.

18. The support table of claim 14, wherein directions of rotation of vacuum wheels of said plurality of wheels are parallel to one another.

19. The support table of claim 14, wherein, in an arrangement of vacuum wheels of said plurality of vacuum wheels, each vacuum wheel of the arrangement is laterally rotated with respect to a neighboring vacuum wheel of the arrangement.

20. A support system for supporting and transporting a substrate, the system comprising:

a plurality of idler wheels whose axes of rotation are parallel to one another;

a plurality of vacuum wheels whose axes of rotation are parallel to the axes of rotation of the idler wheels, each vacuum wheel comprising:

a fixed conduit that is connectable to a suction source;

at least one vacuum surface on a circumference of the vacuum wheel, the vacuum surface including a plurality of vacuum openings that are distributed around the circumference, such that rotation of the wheel causes the vacuum openings of said plurality of vacuum openings to successively fluidically connect to the fixed conduit such that, when suction is applied by the suction source to the fixed conduit, the suction is applied to one or more of said plurality of vacuum openings that are currently fluidly connected to the fixed conduit; and at least one contact surface on the circumference of the vacuum wheel, said at least one contact surface being adjacent to and extending outward beyond the vacuum surface such that, when the suction is applied to said one or more of said plurality of vacuum openings, the substrate is drawn toward the vacuum surface, so as to contact said at least one contact surface without contacting the vacuum surface, and so as to apply a friction force between said at least one contact surface and the substrate to transport the substrate when the wheel rotates.

* * * * *